US006492775B2

(12) United States Patent
Klotz et al.

(10) Patent No.: US 6,492,775 B2
(45) Date of Patent: Dec. 10, 2002

(54) PRE-FABRICATED STAGE INCORPORATING LIGHT-ACTUATED TRIGGERING MEANS

(76) Inventors: Moshe Klotz, 19 Cadogan Gardens, London N3 2HN (GB); Hagai Sigalov, 20 Eastside Road, London NW11 0BA (GB)

( * ) Notice: Subject to any disclaimer, the term of this patent is extended or adjusted under 35 U.S.C. 154(b) by 0 days.

(21) Appl. No.: 09/814,003

(22) Filed: Mar. 22, 2001

(65) Prior Publication Data

US 2002/0047549 A1 Apr. 25, 2002

Related U.S. Application Data

(63) Continuation of application No. PCT/GB99/03177, filed on Sep. 22, 1999.

(30) Foreign Application Priority Data

Sep. 23, 1998 (GB) ..... 9820747

(51) Int. Cl.[7] ..... H05B 37/00
(52) U.S. Cl. ..... 315/120; 250/221; 84/645
(58) Field of Search ..... 315/120, 121, 315/129, 133, 134; 250/221, 271; 84/600, 645, DIG. 1; 340/555, 556

(56) References Cited

U.S. PATENT DOCUMENTS 5,017,770 A * 5/1991 Sigalov ..... 250/221

* cited by examiner

*Primary Examiner*—Haissa Philogene
*Assistant Examiner*—Thuy Vinh Tran
(74) *Attorney, Agent, or Firm*—Birch, Stewart, Kolasch & Birch, LLP

(57) ABSTRACT

A pre-fabricated stage comprising an integrated visible light-source, a device for directing light from the visible light source away from the stage in the form of a beam of light, and corresponding light-detecting devices for detecting such light that is retroreflected back towards the stage. The stage is typically adapted to support the weight of at least one person, and preferably further incorporates a pulse generator associated with each light-detecting device, and a device for generating an electronic instruction code, such, for example, as a MIDI compatible code, in response to an input from the pulse generator for controlling a sound generator or other device. Thus, a person using the stage may play music or control other devices by cutting beams of light directed by the directing device with his/her hands or other parts of the body.

34 Claims, 7 Drawing Sheets

112
116
28
32
54
24
18
142
22
143
14

42
44
48
50
α
175
177
154
214
174
200
208
206
210
212
204
202
172
156
168
162
164
160
166
170
170
158
160
86

PRE-FABRICATED STAGE INCORPORATING LIGHT-ACTUATED TRIGGERING MEANS

This application is a Continuation of PCT International Application No. PCT/GB99/03177 filed on Sept. 22, 1999, which designated the United States and on which priority is claimed under 35 U.S.C. § 120, the entire contents of which are hereby incorporated by reference.

1. Field of the Invention

The present invention relates to a pre-fabricated stage incorporating integrant light-actuated triggering means such, for example, as light-to-sound equipment.

2. Description of the Related Art

U.S. Pat. No. 5,017,770 and GB-B-2183889 (Sigalov), the contents of which are incorporated herein by reference, disclose interactive light-to-MIDI equipment comprising at least one source of visible light and a corresponding light-sensing detector. The detector is connected to a pulse-generator for converting the analogue output of the detector to a MIDI-compatible digital signal. The pulse-generator in turn is connected to a MIDI interface, which interface can be connected to a sound generator or other MIDI-controlled device of the kind well known to those skilled in the art. The MIDI interface can be set-up to transmit a predetermined MIDI instruction to the sound generator or other device in response to a signal from the pulse generator.

Also available to the public is an integrated, single-beam light unit comprising a single light-source and a light-sensing detector. The single-beam light unit can be mounted in any suitable position, for instance on a lighting rig or a stage. In practice a plurality of single-beam units are used, and these are connected to a common MIDI interface, with each unit being used to control a different note or event.

The equipment disclosed by U.S. Pat. No. 5,017,770 and GB-B-2183889 and the single-beam apparatus described above work well in practice, and have been used with excellent results. They have the disadvantage however that they are relatively complicated and time-consuming to install. Moreover, as either form of equipment constitutes, in effect, a musical instrument, a competent musician is required to obtain good results from a musical point of view.

BRIEF SUMMARY OF THE INVENTION

It is an object of the present invention to provide improved interactive, light-actuated triggering equipment, particularly light-to-sound equipment, especially light-to-MIDI equipment.

According to one aspect of the present invention therefore there is provided a pre-fabricated stage.

The present invention thus provides a fully or partially integrated, pre-fabricated stage incorporating light-actuated triggering means that is convenient to install and can easily be transported from one location to another.

In order to facilitate transportation, the stage of the invention may be constructed from a plurality of pre-fabricated staging components, each of which pre-fabricated staging components comprises a platform, supporting means for supporting the platform off the ground, at least one light transmitting means and corresponding light detecting means.

The pre-fabricated stage may thus have a modular construction which is convenient to transport and simple to erect at any location as required.

The pre-fabricated stage may have any shape in plan view. In some embodiments of the invention, the staging components may have various different shapes, so that they can be assembled in a number of different combinations and arrangements to provide stages of different shapes and sizes.

Preferably each staging component comprises a robust housing that is adapted to stand on the ground and has an upper surface constituting the platform. The pre-fabricated stage of the present invention may also be hung from a wall, ceiling or other suitable support, in which case it is not necessary for the stage to be load-bearing.

In another aspect of the present invention, the pre-fabricated stage of the invention comprises a canopy assembly. Said canopy assembly may comprise a roof and roof-supporting means adapted to be connected to the staging components.

In yet another aspect of the present invention, there is provided a light reflector/detector assembly.

In yet another aspect of the present invention there is provided a combined reflector and retroreflector unit.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Following is a description by way of example only with reference to the accompanying drawings which are given by way of illustration only, and thus are not limitative of the present invention, and in which.

DETAILED DESCRIPTION OF THE INVENTION

Figure 1:
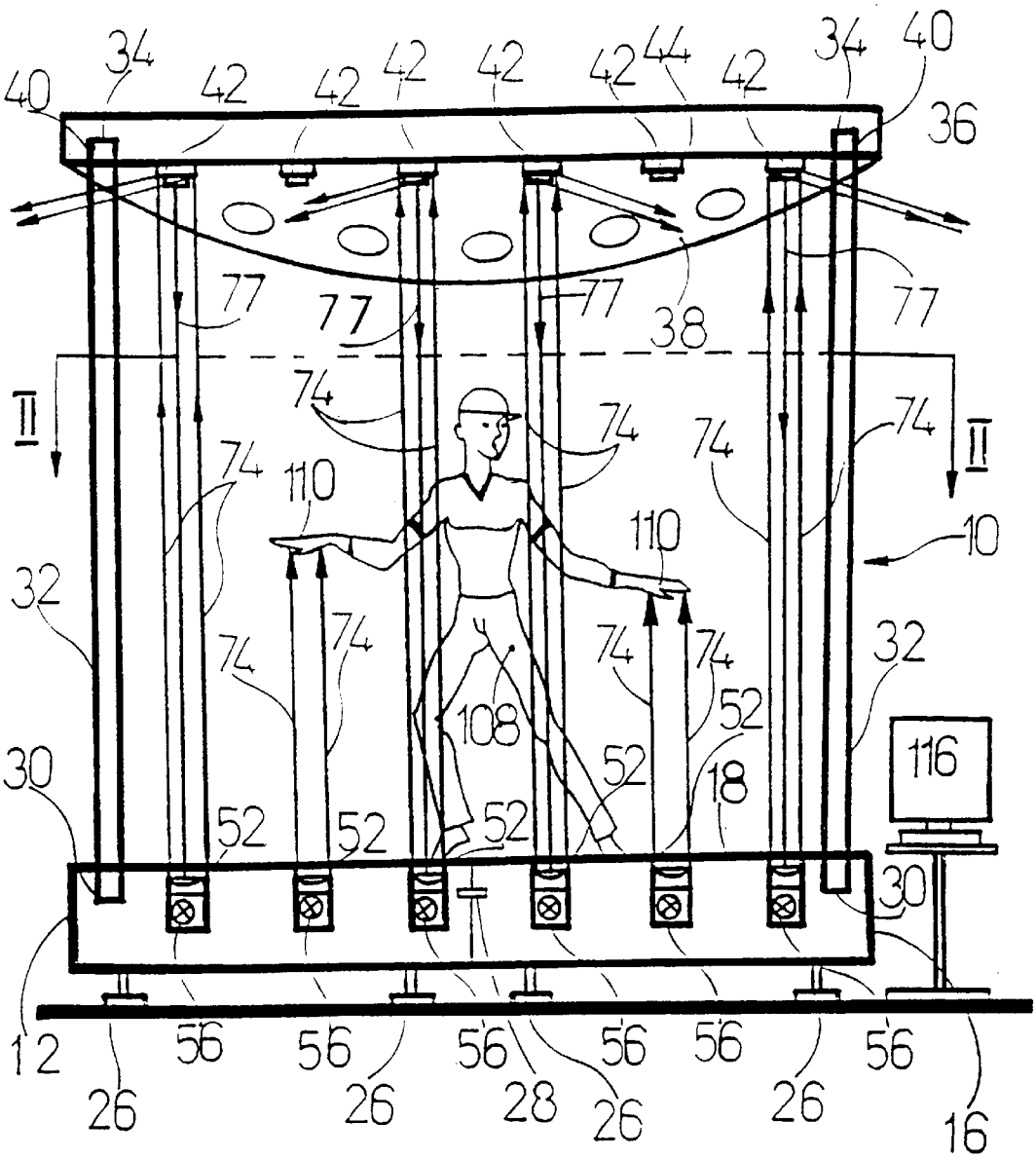
FIG. 1 is a side view, partly in cross-section, of a pre-fabricated stage in accordance with the present invention.
Figure 3:
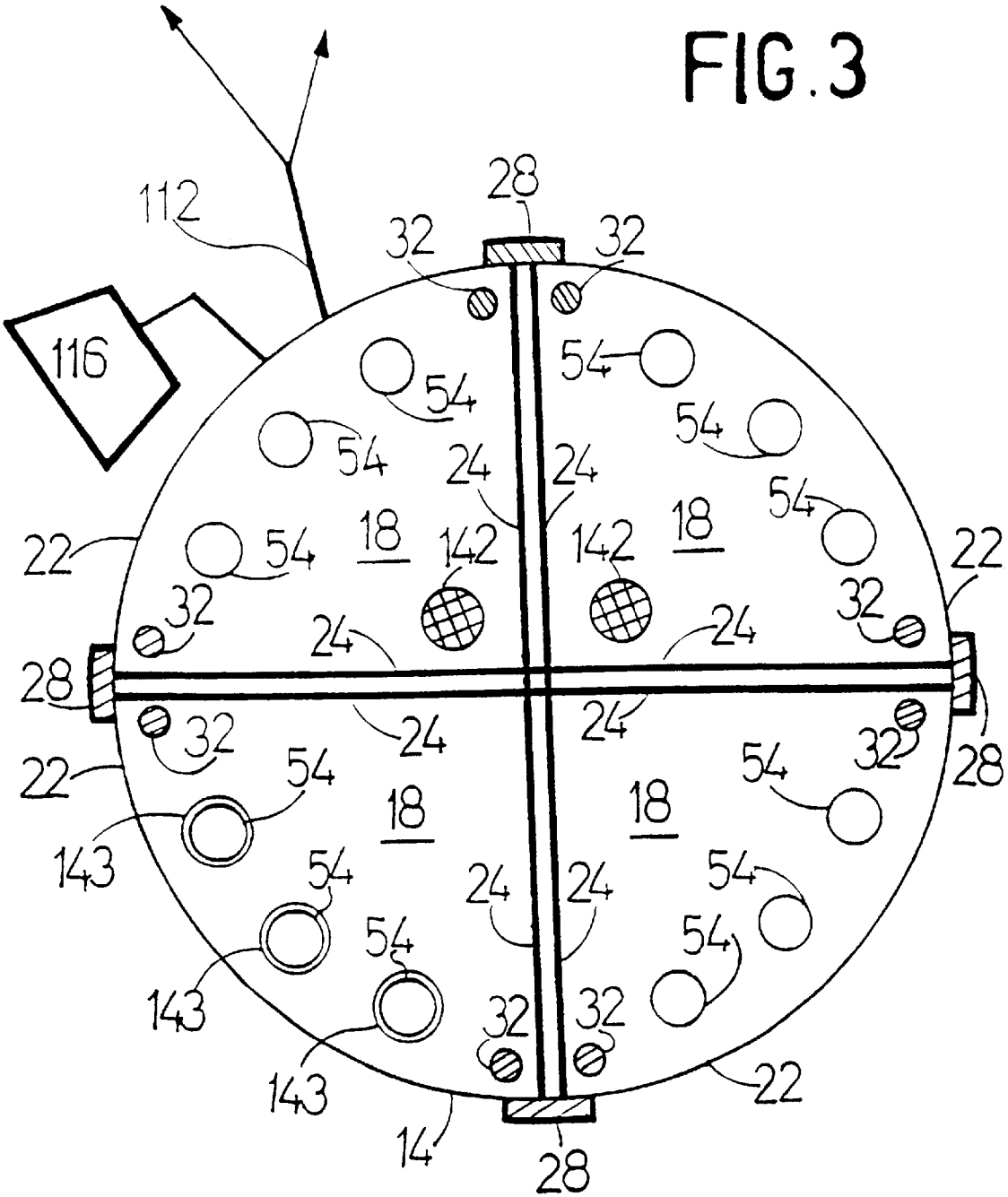
FIG. 3 is a plan view of the stage of FIG. 1, partly in cross-section on the line II—II of FIG. 1.

A stage assembly 10, as shown in FIGS. 1 and 3, comprises a stage 12, which is constructed from a plurality of pre-fabricated staging components 14. The stage is generally circular in plan view, and each of the staging components in plan has the shape of a 90° segment of a circle as shown in FIG. 3. Each component comprises a load-bearing, hollow housing 16 that is pre-fabricated from a structurally robust material, having a substantially flat upper surface 18, which serves as a stage, an underside 20, an arcuate outer side wall 22 and two radial inner side walls 24. Said stage is adapted to support thereon the weight of at least one person. Larger stages in accordance with the invention may be adapted to support the weight of a greater number of people, e.g. 2–20 people.

The staging components 14 are provided on their undersides 20 with feet, legs or castors or other suitable means 26 for supporting the components off the ground as shown in FIG. 1.

The components 14 are further provided with suitable fastening means 28, illustrated schematically in FIGS. 1 and 3, for releasably securing the components to one another to form the stage 12. As fastening means 28 may be used any suitable fastening means known to those skilled in the art such, for example, as interlocking parts provided on the respective staging components 14 or latch/hook arrangements.

The stage 12 of the stage assembly 10 thus has a modular construction which is convenient to transport and simple to erect in situ. Although a circular stage comprising four staging components is shown in the drawings, it will be appreciated that any shape of stage may be provided, and accordingly the staging components may be formed in any convenient shapes. Differently shaped staging components 14 may be provided which can be fitted together in different combinations and arrangements to provide different overall stage shapes. For instance, the four quarter-circular segments stage components 14 shown in FIG. 3 could be combined with one or more rectangular staging components to provide an oblong stage.

The upper surface 18 of each staging component 14 is recessed to provide a plurality of circumferentially spaced sockets 30. Each socket is adapted to accommodate one end of an upwardly extending roof-supporting pole 32 (see FIG. 1). Said poles 32 are adapted to carry at their upper ends 34 a canopy 36. Said canopy 36 may be solid or hollow, and may be made from any suitable self-supporting, light-weight material. Said canopy 36 has a generally flat underside 38, which slopes with respect to the upper surface of the stage. Alternatively the underside 38 of the canopy 36 could be substantially parallel to the upper surface of the stage.

Said underside 38 is provided with a plurality of upwardly extending recesses 40, each of which is adapted to accommodate the upper end 34 of a respective pole 32. The upper and lower ends of the poles 32 may be locked in the recesses in the staging components and canopy by any suitable means known to those skilled in the art.

Figure 2:
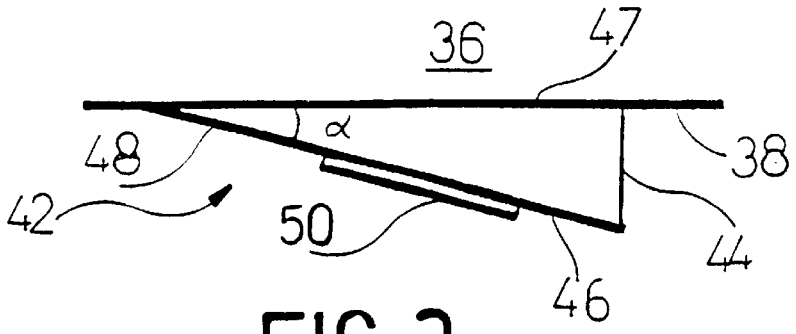
FIG. 2 is a side view of a combined reflector and retroreflector unit according to the invention.

The underside 38 of the canopy 36 further carries a plurality of combined reflector/retroreflector units 42 in accordance with the present invention. Said units 42 may be circumferentially spaced, as shown in the figures, or may be arranged in any other desired configuration. As shown in FIG. 2, each of the units 42 comprises an angled carrier member 44 having a carrying face 46 and a flat base 47 that is adapted to be secured to the underside of the canopy 36. Said carrier face subtends an angle to the base 47 and, when fitted, the underside 38 of the canopy 36. Said angle will typically be in the range 0 to 60°, depending on the slope of the canopy itself. The carrying face 46 of the carrier member 44 carries a layer of reflective material 48 such, for example, as a mirror. At or towards the center of the carrying face 46, there is also provided a retroreflective element 50. Said element may overlay the reflective layer 48 as shown in FIG. 2, or it may be accommodated within a recess or aperture provided for that purpose in the reflective layer.

Figure 4:
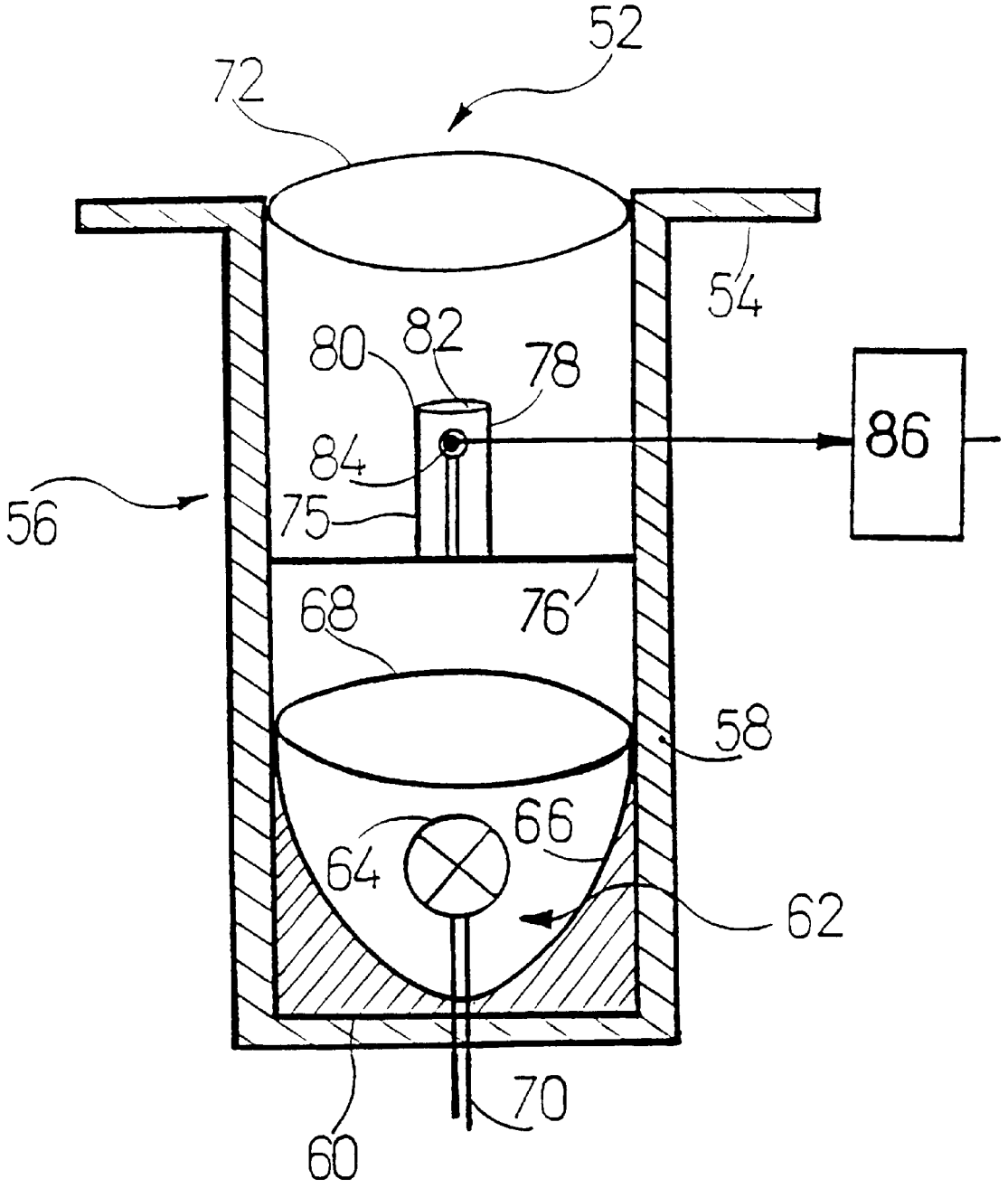
FIG. 4 is a sectional view of a prior art single-beam light unit.

Beneath each reflector unit 42, the stage 12 is equipped with a respective singlebeam light unit 56 of the kind known to those skilled in the art, as shown in FIG. 4. In some embodiments, said light unit 56 may be removable.

Said single-beam light unit 56 includes an elongate casing 58 that is open at its upper end 54 and is closed by a wall at its lower end 60, which elongate casing is accommodated within a respective staging component 14. Juxtaposed its lower end 60, the casing 58 accommodates a light-source 62 comprising a bulb 64, a parabolic reflector 66 and a lens 68. Electrical connections 70 are provided for connecting the bulb 64 to a source of electrical power. The light-source 62 is adapted to throw light from the bulb 64 upwardly through the casing 58, through an optional second lens 72, and through the upper open end 54 of the casing 58.

As mentioned above, the single-beam light unit 56 is positioned below a respective reflector assembly 42 carried on the canopy 36. In use, light from the single-beam light unit 56 shines upwardly as a beam of light 74 as shown in FIG. 1 onto the respective reflector unit 42. The upper surface of the stage 12 may be provided with an aperture 52 to allow light from the light unit 56 to shine therethrough. Alternatively, the upper surface of the stage may be made from a transparent material.

Light that is incident on the reflecting layer 48 is then reflected outwardly of the stage assembly 10 at an angle which will depend on the angle subtended by the carrying surface 46 of the carrier member, the slope of the underside of the roof and the angle of incidence of the beam. Some of the light will be incident on the retroreflecting element 50 which will retroreflect the light back as a reverse beam 77, along the axis of the upwards beam 74, to the single-beam light unit 56. Intermediate said upper and lower ends 54, 60, said single-beam light unit 56 accommodates a detector unit 75 incorporating a photosensitive element 84. Said detector unit 75 may be mounted substantially axially within the casing 58 on a spider 76 beneath the optional lens 72 as shown, or it may be positioned just in front of, and optionally carried by said lens 72. Said detector 75 includes an upstanding, narrow, cylindrical tube 78, having an open upper end 80 that accommodates a lens 82. Said lens 82 is adapted to focus light incident thereon onto the photosensitive element 84 which is accommodated within the tube 78. When light is incident on the element 84, the element outputs a positive signal. Said element 84 is connected to a pulse generator 86, which converts the analogue output signal of the element to a digital pulse signal.

As shown in FIG. 1, the stage 12 may thus comprise a plurality of circumferentially spaced single-beam light units 56 of the kind illustrated in FIG. 4.

Figure 5:
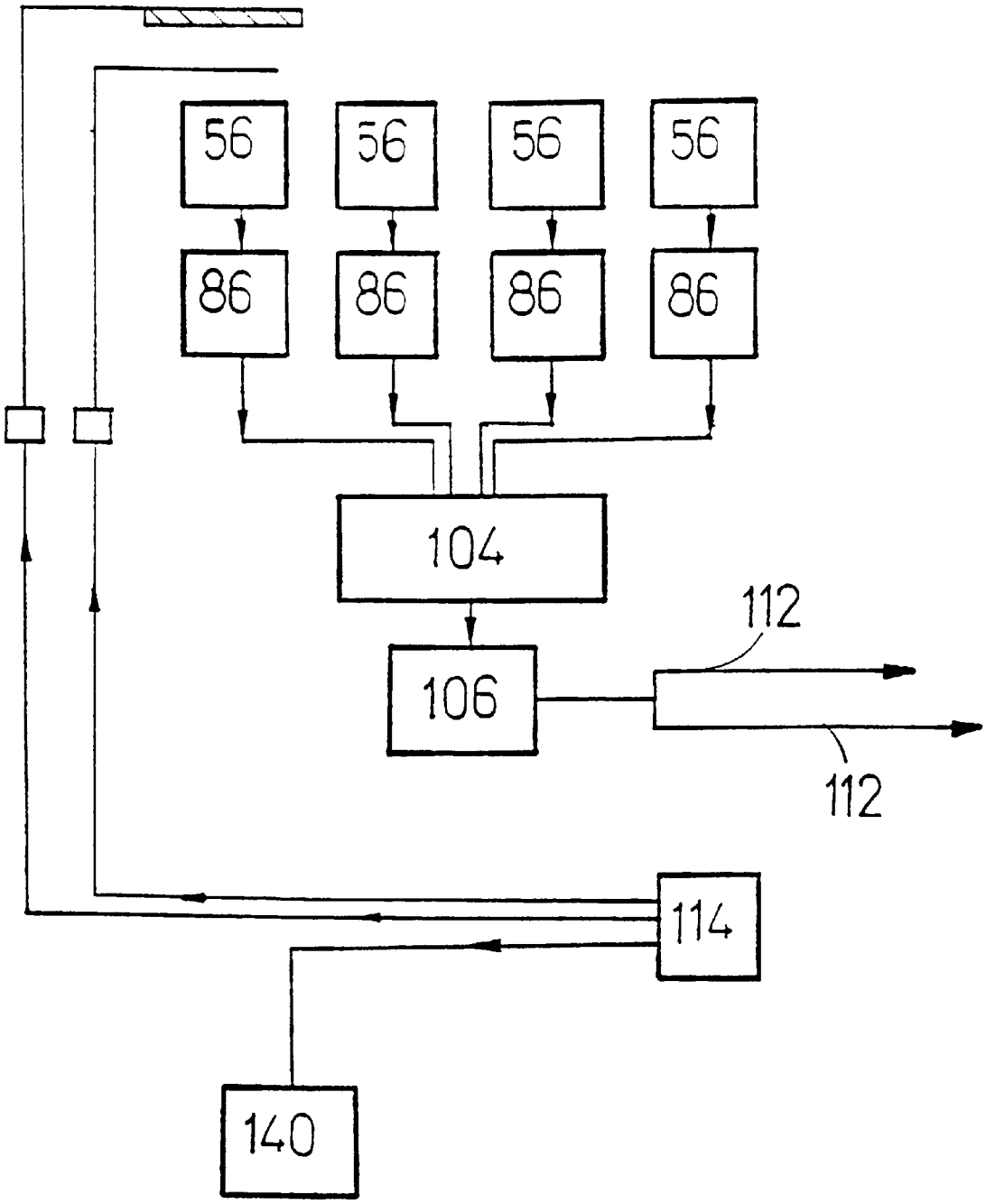
FIG. 5 is a block diagram which shows how the electronic components of the pre-fabricated stage according to the invention can be connected together.

As shown in FIG. 5, the output of each pulse generator 86 is connected to a MIDI interface 104 that is mounted within one of the staging components 14. Said MIDI interface 104 is, in turn, connected to a MIDI-controlled sound generator 106 that is also mounted within one of the staging components 14.

In operation, light from each of the single-beam light units 56 is normally retroreflected back onto the respective light-sensing element 84. The stage is operated by a user 108 who stands on the upper surface 18 of the stage as shown in FIG. 1 and cuts selected beams 74 with his/her hands 110 or any other part of his/her body. When a beam is cut, it is no longer incident on the retroreflecting material 50 on the roof canopy 36, and is thus not available for retroreflection onto the detector unit 75, and the output of the sensing element 84 changes. This gives rise to a pulse in the digital output of the pulse generator 86 which, in turn, causes the MIDI interface 104 to produce a MIDI instruction to the sound-generator 106, which then generates a note or event in response. The output of the sound generator can be connected to a PA system by suitable output connectors 112, as shown in FIG. 5. Usually the PA will be external to the stage assembly 10, but it is envisaged that in some embodiments the stage 12 may also accommodate an amplifier and loudspeakers. The MIDI interface 104 will typically be set-up, such that a signal from the pulse generator 86 of each light unit 56 will give rise to a different note or event. The user can thus play and/or control music by cutting selected beams 74 in sequence.

The sound generator 106 is also connected to a computer 114 having a display 116 juxtaposed the stage 12 as shown in FIG. 1. In some embodiments, the display 116 may be mounted on the stage 12, or may be integral with it. Said computer 114 may be loaded with instructions, which are displayed on the screen 116, for instructing a user on the stage which beams to cut in sequence to play a given melody. Typically, a data storage device of the computer 114 will contain instructions for a plurality of different melodies, and the user 108 will be able to select which melody to play through an input device such as keyboard, a touch sensitive screen or any other suitable pointing device. In some embodiments one or more of the beams may be used to control the computer, e.g. to select different melodies.

Figure 6:
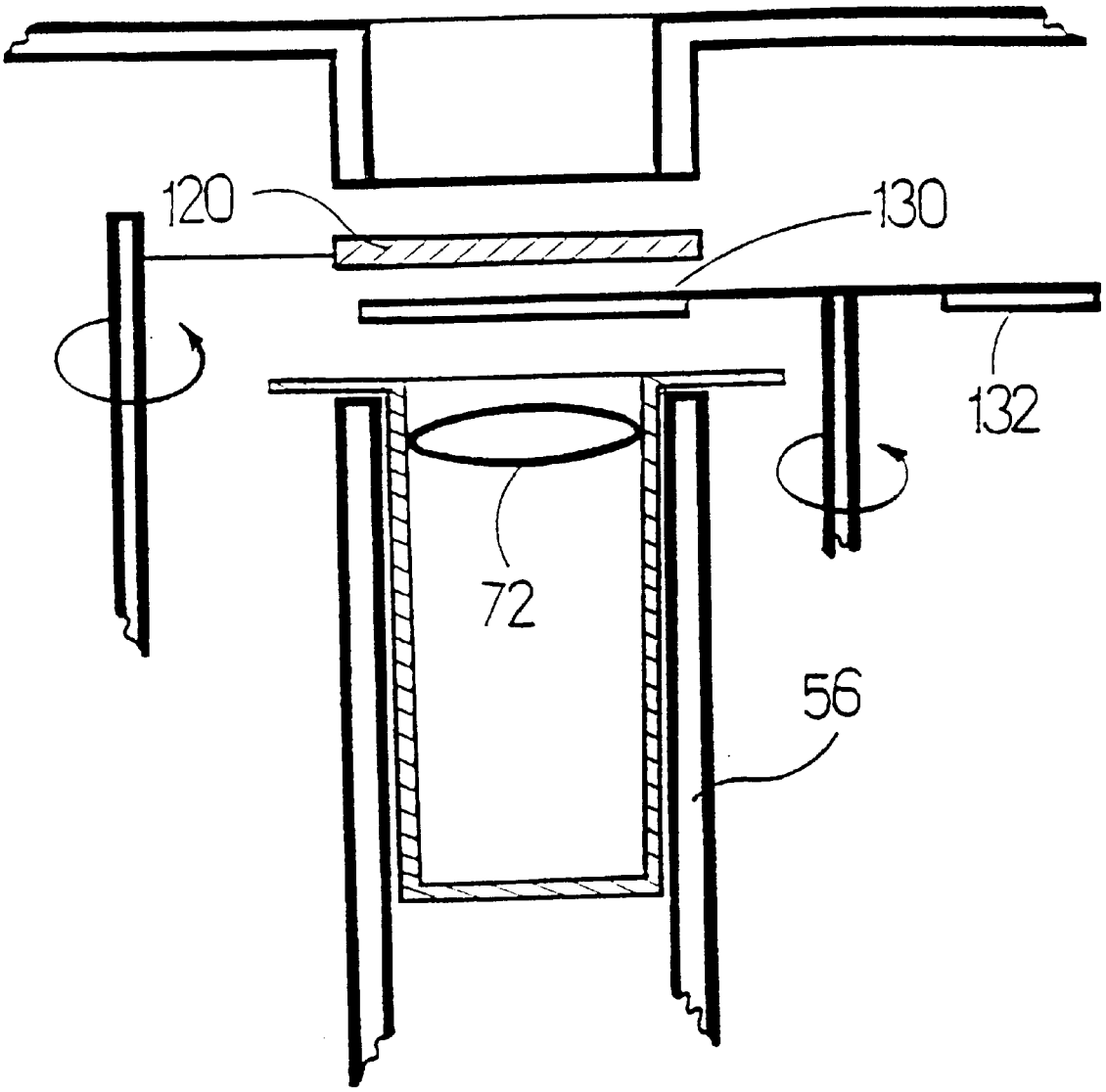
FIG. 6 is an enlarged sectional view of part of a pre-fabricated stage according to the invention, showing the detail of a single-beam light unit and associated shutter and filter devices.

Each of the single-beam light units 56 is associated with an automatically controllable shutter device 120 that is connected to the computer 114 via a suitable interface. The computer 114 can control movement of the shutter device 120 between an open position (not shown) and a closed position as shown in FIG. 6 in which the shutter blocks the beam of light 74 from the light unit 56.

Each single-beam light unit 56 is also associated with an automatically controlled optical filter device 130 comprising a plurality of differently colored or shaped translucent filters 132, which filter device 130 is connected to the computer 114 via a suitable interface. Said computer 114 can control the filter device 130 to bring any selected filter 132 (or no filter) into position over the open end 54 of the light unit 56, so as to change the color of the light beam that is directed upwardly from the stage.

By using the shutter device 120 and/or the optical filter device 130, the computer loaded with suitable instructions can operate the stage assembly in a number of different modes. For instance, for any given melody, the computer may operate the stage assembly in a "follow-me" mode, by which each successive note of a melody is indicated to be played by flashing or changing the color of the corresponding beam 74. When the user 108 cuts the appropriate beam 74, the computer then indicates the next note to be played, and so on. Alternatively, the computer may contain instructions for playing any given melody in a "Simple Simon" mode, by which progressively larger groups of notes are indicated to be played by flashing or changing color of the corresponding beams 74. The user then attempts to reproduce the melody by cutting the appropriate beam 74 with a part of his or her body. If the user gets the melody right, then the computer indicates the next, incrementally larger group of notes to be played in sequence, and so on. In either mode, if the user plays the melody correctly, then the computer may indicate this fact in some way, either by a predetermined sequence of light flashes or by means of a message on the display 116. As an alternative to said shutter device 120, the computer, through a suitable interface, may control operation of the single-beam light unit 56 so as to cause the bulb 64 to blink on and off, causing an intermittent or flashing beam.

The stage assembly of the present invention may further be equipped with one or more special effect devices, such as smoke-generating equipment 140, which may be controlled automatically by the computer 114, via a suitable interface, at appropriate points in a given melody or other piece of music. Alternatively, one or more of the beams 74 (designated control beams) may be arranged to trigger operation of the smoke-generating machine 140. One or more of the staging components 14 may be provided with smoke outlets 142,143 in the upper surface 18 thereof. Said smoke outlets may be positioned generally centrally of the stage 12 (as at 142) and/or circumjacent some or all of the light units 56 (as at 143). Said smoke outlets (142,143) may be overlaid with a protective grill where necessary as shown in FIG. 3.

Figure 7:
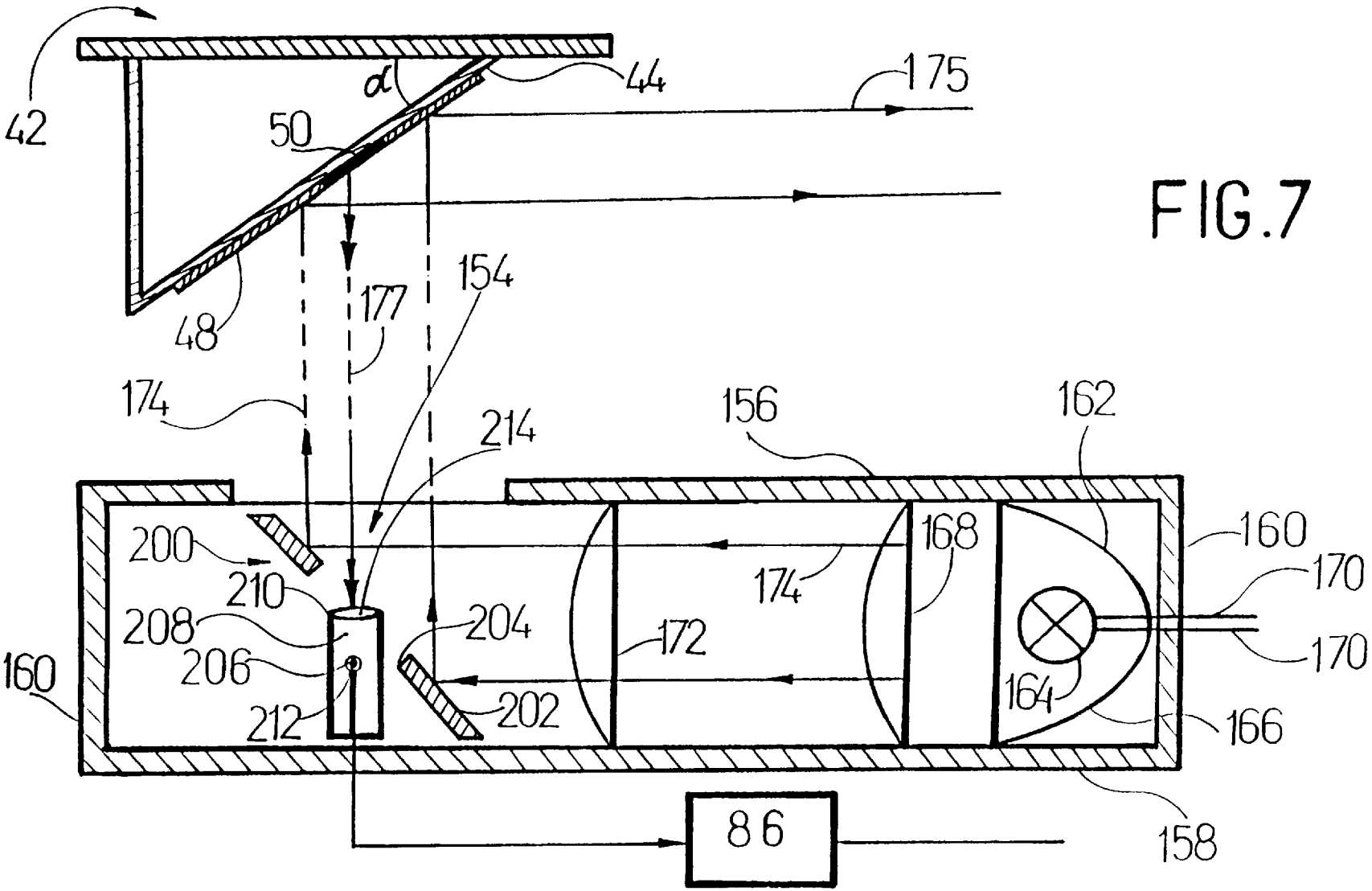
FIG. 7 is a sectional view of another single-beam light unit and a corresponding combined reflector and retroreflector unit in accordance with the invention.

Another single-beam light unit 156 in accordance with the present invention is illustrated in FIG. 7. Said light unit 156 includes an elongate casing 158 that is designed to be mounted generally horizontally within the stage 12 of the assembly 10. The casing 158 is closed at each end by an end wall 160, and the side of the casing 158 is formed with an aperture 154 towards one end. At the other end, the casing 158 accommodates a light-source 162 comprising a bulb 164, a parabolic reflector 166 and a lens 168. Electrical connections 170 are provided for connecting the bulb 164 to a source of electrical power. The light-source 162 is arranged to throw light from the bulb 164 longitudinally within the casing towards the one end as a beam 174. A second optional lens 172 as shown in FIG. 7 may be positioned intermediate the first lens 168 and the aperture 154.

Juxtaposed the aperture 154, the casing 158 accommodates a reflector/detector assembly 200 in accordance with the present invention. Where the light-source generates substantial heat, it is advantageous to separate the light source and the detector. Said reflector/detector assembly 200 comprises a plane mirror 202 which is tiltably mounted within the casing 158, such that the angle of incidence of the mirror 202 to the beam 174 an be varied. Said mirror 202 is provided with a generally central aperture 204 which accommodates a light sensitive detector 206. Said detector unit 206 may be mounted on the mirror 202 itself or separately within the casing 158. Said detector unit 206 comprises an outer, generally cylindrical tube 208 which is open at one end 210 and accommodates a photosensitive element 212 which is connected to a pulse generator 86 as shown in FIG. 7. The open end of the tube 208 is fitted with a lens 214. As shown in FIG. 7, the detector unit 206 is mounted such that the open end 210 of the tube 208 lies generally within the plane of the mirror 202. Said detector unit 206 is tiltably mounted such that its orientation can be adjusted relative to the position of the mirror 202. In some embodiments, the tilting action of the mirror 202 and/or the detector unit 206 may be motorised.

As shown in FIG. 7, said beam 174 from the light source 162 is incident on the mirror 202 which reflects the beam 174 upwards through the aperture 154, through an aperture or transparent plate provided in the upper surface 18 of the stage 12 and onto a corresponding reflector unit 42 as described above. Some of the light incident on the reflector unit 42 will be reflected away from the stage assembly as shown at 175. A proportion of the light however will be retroreflected by the retroreflected element 50 back towards the stage 12 as a reverse beam 177, where it will be incident on the detector unit 206. The orientation of the detector unit 206 is adjusted such that the axis of the tube 208 is aligned with the beam 174 reflected by the mirror 202, such said reverse beam 177 is incident on the lens 214 in open end 210 of the detector 206 which focuses such light onto the photosensitive element 212 as described above.

Figure 8:
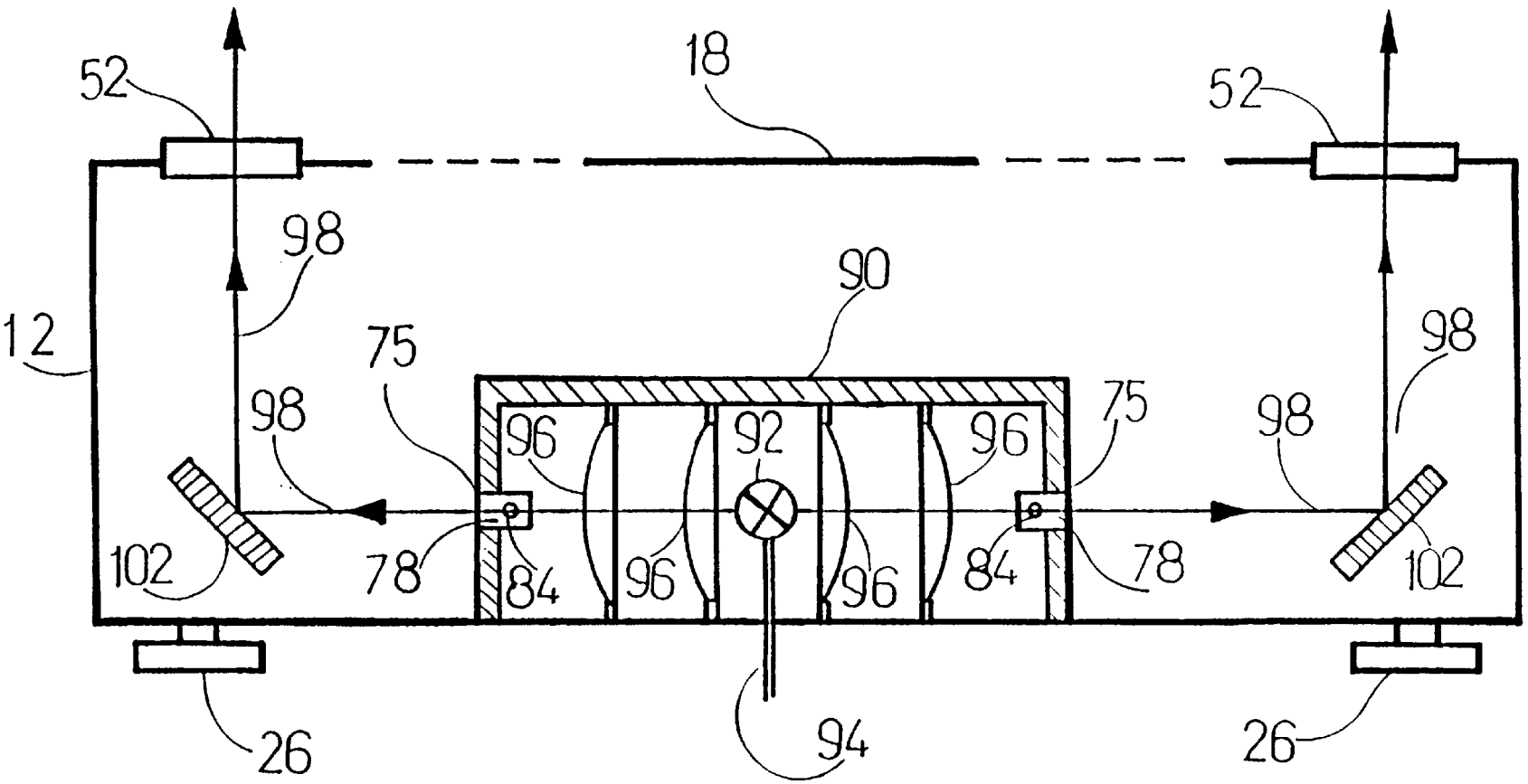
FIG. 8 is a sectional side view of a pre-fabricated stage assembly in accordance with the present invention incorporating a multi-beam light unit.

In an alternative embodiment of the invention, the stage 12 may accommodate a multi-beam light unit 90 as shown in FIG. 8. Said multi-beam light unit 90 may be mounted substantially centrally within the stage 12 within one of the staging components 14. In some embodiments, the multi-beam light unit 90 may be removable from the stage 12. Said multi-beam light unit 90 comprises a bulb 92 that is provided with electrical connections 94 and a plurality of circumferentially spaced lenses 96 that are adapted to direct light from the bulb 92 radially outwardly of the source 90 as a plurality of generally horizontal beams 98. Each beam 98 is incident on a respective mirror 102 or other reflecting member that is mounted within the stage 12. Said mirror 102 is oriented to reflect the beam 98 upwardly within the stage 12, through an aperture or transparent plate 52 in the upper surface 18 of the stage onto a respective reflector assembly 42 carried by the canopy 36. Some of the light incident on the reflector assembly 42 is reflected away from the stage assembly 10, and some is retroreflected in the manner described above back towards the stage 12.

The retroreflected part of the light is reflected back along the axis of the beam 98 to the mirror 102, where it is reflected back towards to the multi-beam light unit 90. Said multi-beam light unit 90 includes a detector unit 75 that is positioned on the axis of each beam 98. Said detector unit 75 incorporates a photosensitive element 84 that is accommodated within a cylindrical tube 78 as described above with reference to FIG. 3. The retroreflected component of each beam 98 is thus incident on the photosensitive element 84 within a respective detector unit 75, and the output of the photosensitive element 84 is connected to a pulse generator (not shown) in the same way as described above.

It is also envisaged that the reflector/detector assembly 200 in accordance with the invention may be used with a multi-beam unit, omitting the detector unit 75 integral with the multi-beam unit. In particular, it is envisaged that a respective reflector/detector assembly 200 may be associated with each beam 98 produced by the multi-beam unit 90.

The stage apparatus of the present invention has the advantage that it is self-contained, convenient to transport and is simple to assemble and operate at any location as required. The assembly does not require rigging or trussing. The stage assembly of the invention can be used in night clubs, discotheques, mobile DJ's, leisure centers, rehabilitation centers, theme parks, schools and in the home. The assembly may also be used for shows, fashion shows and in the theatre industry. It may also be useful for educational purposes, and in displays and exhibitions such, for example, as advertising displays.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pre-fabricated stage comprising a platform, means for supporting said platform off the ground, an integrated visible light source, light directing means for transmitting light from said visible light source away from the stage in the form of a beam of light and corresponding light-detecting means adapted to detect such light that is retroreflected back towards the stage.

2. The stage as claimed in claim 1, further comprising a plurality of light directing means and a plurality of corresponding light-detecting means.

3. The stage as claimed in claim 1 or claim 2, further comprising a pulse-generator associated with the light-detecting means for producing a digital pulse signal in response to an analogue output from said light-detecting means.

4. The stage as claimed in claim 3, further comprising means for generating an electronic instruction code in response to the digital pulse signal produced by the pulse generator, which instruction code comprises instructions for operating another device.

5. The stage as claimed in claim 4, wherein said electronic instruction code is MIDI compatible.

6. The stage as claimed in claim 4, wherein said means comprise a MIDI interface adapted to receive an input from the pulse generator and to output MIDI instruction code.

7. The stage as claimed in claim 4, further comprising an integrated sound-generator or other device that is capable of recognizing and being operated by said electronic instruction code.

8. The stage as claimed in claim 7, further comprising an integrated public address system comprising an amplifier and one or more loudspeakers, which amplifier is adapted to receive an input from the sound-generator.

9. The stage as claimed in claim 7, further comprising controlling means for controlling operation of the sound generator in response to said instruction code.

10. The stage as claimed in claim 9, wherein said controlling means includes a sequencer or a computer comprising a processor, a memory device, and input means for allowing a user to control the computer.

11. The stage as claimed in claim 9, wherein the light-directing means is associated with a shutter device for selectively obscuring the corresponding beam, which shutter device can be controlled by the controlling means.

12. The stage as claimed in claim 9, wherein said controlling means is arranged to control operation of the light-source for selectively causing the light source to blink.

13. The stage as claimed in claim 9, wherein the light directing means is associated with an automatically controllable light filter device which is adapted to introduce selectively one or more color filters into the beam, so as to change the color light beam, the automatically controllable filter being controlled by the said controlling means.

14. The stage as claimed in claim 9, wherein said controlling means is integrated with the pre-fabricated stage.

15. The stage as claimed in claim 1, wherein the stage is constructed from a plurality of pre-fabricated staging components comprises a platform, supporting means for supporting the platform off the ground, at least one light-directing means and corresponding light-detecting means.

16. The stage as claimed in claim 1, further comprising a canopy assembly, the canopy assembly including a roof and roof supporting means adapted to be connected to the staging components.

17. The stage as claimed in claim 16, wherein an underside of the roof is provided with one or more retroreflecting elements, the one or more retroreflecting elements being associated with a respective light-directing means on the stage.

18. The stage as claimed in claim 16 or 17, wherein an underside of the roof is provided with reflecting means for reflecting light from the light-directing means.

19. The stage as claimed in claim 16, wherein said reflecting means comprises a plurality of reflecting elements, each element being associated with a respective light-direction means.

20. The stage as claimed in claim 16, wherein an underside of the roof is equipped with reflecting elements and retroreflecting elements.

21. The stage as claimed in claim 1, wherein the stage is portable.

22. A light reflector/detector assembly comprising a mirror adapted to reflect light from a light-source as a substantially parallel beam of light and light-detecting means for detecting light reflected by the mirror that is retroreflected back towards the mirror, wherein the mirror is provided with an aperture therein, and said light detecting means is disposed within the aperture.

23. The assembly as claimed in claim 22, wherein the mirror comprises a plane mirror, and said aperture is positioned at or towards the center of said mirror.

24. The assembly as claimed in claim 22 or claim 23, further comprising mirror tilting means for selectively tilting said mirror so as to control the direction of the beam away from the mirror.

25. The assembly as claimed in claim 24, wherein said mirror tilting means are motorized.

26. The assembly as claimed in claim 24, wherein said light detecting means is tiltable with respect to the mirror, such that the light-detecting means can be aligned substantially parallel to the beam of light reflected by the mirror.

27. The assembly as claimed in claim 26, further comprising motorized tilting means for tilting said light-detecting means.

28. The assembly as claimed in claim 27, further comprising controlling means for controlling operation of the motorized tilting means to ensure that the light-detecting means remains correctly aligned with the reflected beams.

29. The assembly as claimed in claim 22, wherein said light-detecting means comprises an elongated tube, which tube accommodates a light sensitive element.

30. The assembly as claimed in claim 22, wherein the mirror is positioned at about 45 degrees to the axis of an incident beam of light, and the tube is oriented at about 90 degrees to said incident beam.

31. The combined reflector/retroreflector unit adapted for use with an interactive light-actuated triggering system comprising means for directing light away from a light-source in the form of a beam, means for retroreflecting said beam, light detecting means positioned within said retroreflected beam, and means for generating an electronic trigger signal in response to a change in the intensity of light from said retroreflected beam that is incident on said detecting means, which combined reflector/retroreflector unit comprises retroreflecting means for retroreflecting said beam towards the detecting means and integrant reflecting means for reflecting light away from the detecting means.

32. The combined reflector/retroreflector unit as claimed in claim 31, wherein said reflecting means comprises a layer of reflective material disposed on a suitable carrier.

33. The combined reflector/retroreflector unit as claimed in claim 32, wherein said carrier comprises a flat base and a carrying face that subtends an angle a with the base, which angle a is in the range of 0–60°.

34. The combined reflector/retroreflector unit as claimed in claim 32 or claim 33, wherein said retroreflecting means comprises a retroreflective element that is superposed on said reflective material or is accommodated in a recess or aperture provided for that purpose in the reflective material.

* * * * *